US010174983B2

(12) United States Patent
Williams

(10) Patent No.: US 10,174,983 B2
(45) Date of Patent: Jan. 8, 2019

(54) ICE CUBE TRAY DEVICE

(71) Applicant: Damar Williams, New York, NY (US)

(72) Inventor: Damar Williams, New York, NY (US)

( * ) Notice: Subject to any disclaimer, the term of this patent is extended or adjusted under 35 U.S.C. 154(b) by 48 days.

(21) Appl. No.: 15/162,230

(22) Filed: May 23, 2016

(65) Prior Publication Data

US 2016/0341461 A1 Nov. 24, 2016

Related U.S. Application Data

(60) Provisional application No. 62/165,595, filed on May 22, 2015.

(51) Int. Cl.
*F25C 1/24* (2018.01)
*F25C 1/243* (2018.01)

(52) U.S. Cl.
CPC ..... *F25C 1/243* (2013.01); *F25C 2500/02* (2013.01)

(58) Field of Classification Search
CPC .. F25C 1/00; F25C 5/005; F25C 1/243; F25C 2500/02; F25C 2500/06; F25C 1/24; F25C 1/22
USPC ..... 62/66, 347, 352, 356
See application file for complete search history.

(56) References Cited

U.S. PATENT DOCUMENTS

| | | | | |
|---|---|---|---|---|
| 2,340,675 A * | 2/1944 | Mallard | F25C 1/24 | 249/133 |
| 2,941,377 A * | 6/1960 | Nelson | F25C 1/04 | 219/200 |
| 3,025,679 A * | 3/1962 | Keighley | F25C 1/24 | 62/139 |
| 4,942,742 A * | 7/1990 | Burruel | F25C 1/04 | 249/119 |
| 5,582,754 A * | 12/1996 | Smith | F25C 1/24 | 219/386 |
| 7,059,140 B2 * | 6/2006 | Zevlakis | F25C 1/04 | 62/340 |
| 2005/0151049 A1 * | 7/2005 | Lion | F25C 1/24 | 249/121 |

* cited by examiner

*Primary Examiner* — Melvin Jones
(74) *Attorney, Agent, or Firm* — Ruth Eure

(57) ABSTRACT

An ice cube tray device for creating ice plugs for a beverage container is provided. The beverage container has an opening. The ice cube tray device comprises an ice tray having a top surface, a bottom surface opposite the top surface, a first end, and a second end opposite the first end. A plurality of recessed receptacles are formed in the top surface of the ice tray between the first end and the second end. Each of the recessed receptacles have a substantially rounded cylindrical configuration thereby creating ice plugs having the same configuration as the recessed receptacles that are capable of being received within the opening of the beverage container.

13 Claims, 1 Drawing Sheet

ICE CUBE TRAY DEVICE

CLAIM OF PRIORITY

This patent application claims priority under 35 USC 119 (e) (1) from U.S. Provisional Patent Application Ser. No. 62/165,595 filed May 22, 2015, of common inventorship herewith entitled, "Freezer Mate," which is incorporated herein by reference as though the same were set forth in its entirety.

FIELD OF THE INVENTION

The present invention pertains to the field of freezer accessories, and more specifically to the field of ice cube trays.

BACKGROUND OF THE INVENTION

Inventions are always a product of vision and creativity whether they are world changing inventions like cars and computers or everyday conveniences like pump hairsprays, cordless tools and resealable soda bottles. New inventions like a cell phone change a person's life style, making communication more convenient and accessible virtually anywhere. Other inventions such as a snow scraper and brush combine two already existing inventions into an improved embodiment, reducing clutter in our lives and making daily winter chores much easier. Often necessity combined with a little creativity is the underlying motivator for an invention. Most inventions fill a relatively small need or perform a specialized limited function. If that need is shared by a sufficient number of consumers, an invention has a great potential for success.

People consume many gallons of bottled drinks and water, and they want their beverage to be cold. Bottled beverages quickly lose their chill and appeal once they are removed from a refrigerator and sit for a while on a desk or in a purse or book bag. Whether a household has an icemaker for crushed and cubed ice or relies upon traditional ice cube trays, members of the household face a similar problem when it comes to chilling a bottled beverage for on the go consumption. While a drinker can put ice and beverage into a commuter cup, the originating bottle or jug container is much more convenient and cleaner to carry. Trying to get ice cubes into the bottle or jug is impossible as the ice cubes often are too big to fit through the opening of the container. Trying to fill the bottle with crushed ice from the ice maker results in a wet and melting mess.

The prior art has put forth several designs for ice trays. Among these are:

U.S. Patent 2012/0055188 to Mark Levie describes a combination ice cube tray and ice cube lifter that includes a tray having a plurality of openings and a lifting device. The tray has one or more recesses, each of which has a bottom wall and side walls that extend upwardly from and contiguously around the bottom wall for forming one or more ice cubes therein. The lifting device has a base portion and a top member. The base portion includes one or more cradles configured to seat within the one or more recesses of the tray to seat against the bottom wall of each of the one or more recesses of the tray. Each of the one or more cradles is coupled to an upstanding member. The top member couples to the upstanding members.

U.S. Pat. No. 6,345,802 to Pamela R. Moore describes an article for forming a freezable substance and includes a body having at least one cavity. The cavity has an open top, an open bottom and side walls there between. The top has a maximum width Wm, with Wm being less than or equal to approximately eight hundred seventy five hundredth of an inch or twenty two and twenty three hundredth millimeters. The width Wm is chosen so that a long cylindrical ice cube is formed within the cavity. The ice cube so formed fits easily into original containers of beverages such as soda cans and bottles, so that the beverages are cooled in their original containers.

U.S. Pat. No. 5,971,352 to Kelly Kirks describes an ice bar tray for making various lengths of ice bars for use in different types and sizes of water bags. Each ice bar has a round cross section for ease in inserting into circular water fill openings in a water bag. The ice bar tray includes at least one elongated bar cylinder with a tray handle on each end. The bar cylinder has an elongated cylinder opening in a top of the cylinder for receiving water into a water channel. The water channel has a circular cross section. The water channel is disposed along a length of the elongated cylinder. When the water channel is filled with water and the water freezes, a round ice bar is formed therein. By flexing the ice bar tray, which is made of a flexible PVC plastic material and the like, the frozen ice bar is released outwardly from the water channel and through the cylinder opening. The ice bar is then inserted into the water fill opening in the water bag. The ice bar tray also includes a tray slide with at least one cylinder divider. By sliding the tray slide along the length of the water channel, the cylinder divider allows the user of the ice bar tray to make various lengths of ice bars. While an ice bar has a round cross section, it is also formed having a half round cross section or three quarter round cross section.

None of these prior art references describe the present invention.

SUMMARY OF THE INVENTION

It is an object of the present invention to provide an ice cube tray in which water is frozen into rounded cylindrical plugs of graduated diameter sizes that easily fit in original beverage containers.

The present invention is an ice cube tray device for creating ice plugs for a beverage container. The beverage container has an opening. The ice cube tray device comprises an ice tray having a top surface, a bottom surface opposite the top surface, a first end, and a second end opposite the first end. A plurality of recessed receptacles are formed in the top surface of the ice tray between the first end and the second end. Each of the recessed receptacles have a substantially rounded cylindrical configuration thereby creating ice plugs having the same configuration as the recessed receptacles that are capable of being received within the opening of the beverage container.

In addition, the present invention is a method for creating ice plugs for a beverage container. The beverage container has an opening. The method comprises providing an ice tray having a top surface, a bottom surface opposite the top surface, a first end, and a second end opposite the first end, forming a plurality of recessed receptacles in the top surface of the ice tray between the first end and the second end, forming the recessed receptacles having a substantially rounded cylindrical configuration, creating ice plugs having the same configuration as the recessed receptacles, and inserting the ice plugs into the opening of the beverage container.

The present invention further includes an ice cube tray device for creating ice plugs for a beverage container. The beverage container has an opening. The ice cube tray device comprises an ice tray having a top surface, a bottom surface opposite the top surface, a first end, and a second end opposite the first end. A plurality of recessed receptacles are formed in the top surface of the ice tray between the first end and the second end with the plurality of recessed receptacles having a variety of sizes and the plurality of recessed receptacles have diameters that are graduated in size from smallest recessed receptacle to largest recessed receptacles. The largest recessed receptacles are positioned nearingly adjacent the first end and the second end of the ice tray nearingly adjacent each of approximately four corners of the ice tray and the smallest recessed receptacles are positioned in the approximate center of the ice tray between the first end and the second end of the ice tray. Each recessed receptacle extends from the bottom surface of the ice tray in a generally downward direction and each of the recessed receptacles have a substantially rounded cylindrical configuration thereby creating ice plugs having the same configuration as the recessed receptacles that are capable of being received within the opening of the beverage container.

DETAILED DESCRIPTION OF THE INVENTION

Figure 1:
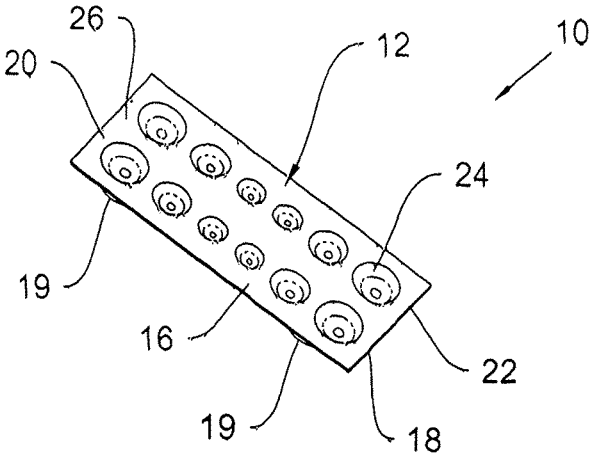
FIG. 1 is a perspective view illustrating an ice cube tray device, constructed in accordance with the present invention, showing an ice tray with round edged water receptacles in three different size diameters dispersed along the ice tray.
Figure 2:
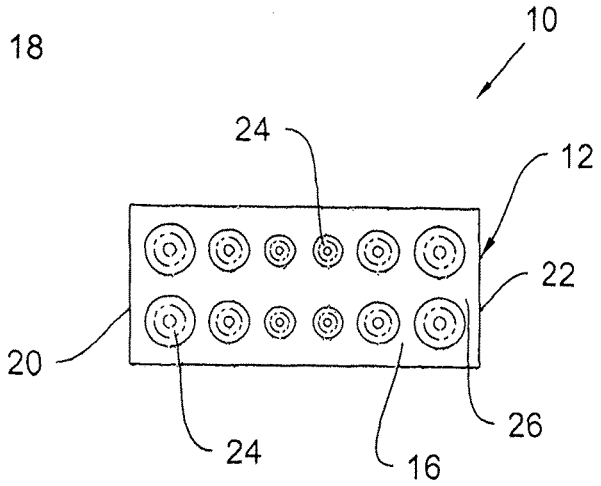
FIG. 2 is another perspective view illustrating the ice cube tray device, constructed in accordance with the present invention, showing the ice tray with round edged water receptacles in three different size diameters dispersed along the ice tray.
Figure 3:
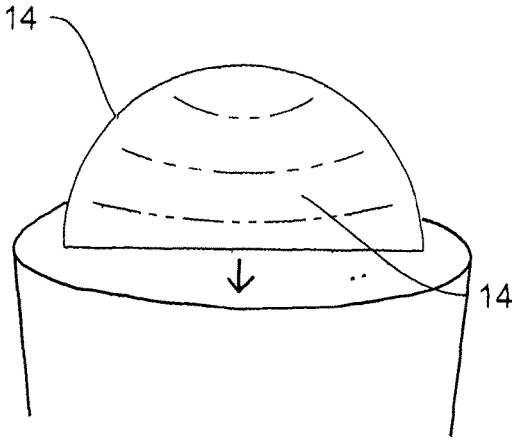
FIG. 3 is a perspective view illustrating ice plugs created by the ice cube tray device, constructed in accordance with the present invention.

The present invention, hereinafter referred to as the Ice Cube Tray Device, indicated generally at 10, is an ice cube tray 12 in which water is frozen into graduated, specifically sized ice cylinders or ice plugs 14, rather than into conventional cubes. The rounded ice plugs 14 produced by the Ice Cube Tray Device 10 are effectively functional in chilling a variety of bottled beverages from personal water bottles to family sized jugs of fruit juice. In fact, the Ice Cube Tray Device 10 provides an ice cube tray 12 configured specifically for use with plastic bottles and jugs in which a wide variety of beverages are packaged such as bottled water, soft drinks, fruit juices, and sports drinks.

The ice cube tray 12 of the Ice Cube Tray Device 10 of the present invention has a top surface 16, a bottom surface 18 opposite the top surface 16, a first end 20, and a second end 22 opposite the first end 20. Formed in the top surface 16 of the ice cube tray 12 between the first end 20 and the second end 22 are a plurality of recessed receptacles 24 or compartments for receiving an amount of water or other beverage. Also, formed on the first end 20 and the second end 22 of the ice cube tray 12 is a molded handle 26 or grip allowing a user to easily grasp and remove the ice plugs 14 from within the recessed receptacles 24.

Preferably, the recessed receptacles 24 of the ice cube tray 12 of the Ice Cube Tray Device 10 of the present invention are provided having diameters in a variety of three sizes. In a preferred embodiment, the ice cube tray 12 includes three different sized recessed receptacles 24 that are graduated in size. The largest recessed receptacles 24 are positioned nearingly adjacent the first end 20 and the second end 22 of the ice cube tray 12 on each of approximately four corners of the ice cube tray 12. All of the receptacles are one and one half inches deep. Being the widest, the large corner recessed receptacles 24 extend from the bottom surface 18 of the ice cube tray 12 and hold water or other beverage that freezes into large ice plugs 14. Different sized pair sets of medium and smaller recessed receptacles 24 reside in the remaining top surface 16 of the ice cube tray 12 between the outside corner compartments. In a preferred embodiment, the ice cube tray 12 contains approximately twelve recessed receptacles 24 although having an ice cube tray 12 with more or less recessed receptacles 24 is within the scope of the present invention.

When placed in a freezer, the water or other beverage in the recessed receptacles 24 of the ice cube tray 12 of the Ice Cube Tray Device 10 of the present invention freeze into ice cylinders or plugs 14 in a variety of diameters from approximately one half inch to one and one half inches and a uniform depth of one and one half inches. The diameters of the ice plugs 14 produced within the ice cube tray 12 are sized and configured to fit through the tops of plastic beverage bottles and jugs with minimal clearance. The ice plugs 14 created in the ice cube tray 12 are sized and configured to accommodate different sized bottles and jugs, ranging from approximately one-half, two, and three liter bottles to two quart jugs.

The ice cube tray 12 of the Ice Cube Tray Device 10 of the present invention is stackable with other ice cube trays 12 to save space in a freezer or storage cabinet or drawer. Preferably, the ice cube tray 12 measures approximately nine (9") inches in length, three and one half (3½") inches in width, and one and one half (1½") inches in depth although constructing the ice cube tray 12 in greater or lesser sizes is within the scope of the present invention. In addition, preferably, the ice cube tray 12 is fabricated in food-grade, injection molded thermoplastic although constructing the ice cube tray 12 from a different material is within the scope of the present invention.

Using the Ice Cube Tray Device 10 of the present invention is simple and straight forward. First, water or other desired beverage is poured into the recessed compartments 24 of the ice cube tray 12, to the top surface 16 of the ice cube tray 12 completely filling the recessed receptacles 24. Next, the ice cube tray 12, with the water filled recessed receptacles 24, is placed on a shelf within a freezer. If using multiple ice cube trays 12, fill each of the recessed receptacles 24 of the remaining empty ice cube trays 12 with water or other beverage and carefully stack them one at a time above the first ice cube tray 12 placed on the shelf within the freezer. When the water or other beverage in the ice cube tray 12 has frozen solid, remove each ice cube tray 12 from the freezer. Turn the ice cube tray 12 upside down, lift the ends 20, 22 of the ice cube tray 12 slightly, and use dynamic thumb pressure along the bottom surface 18 of the ice cube tray 12 to eject the ice plugs 14 into a sink or bowl. Place a desired amount of ice plugs 14 in the bottled or jugged beverage. Refill the empty ice cube tray 12 with water or other beverage and return the ice cube tray 12 to the freezer to freeze and make ice plugs 14 again. The ice cube trays 12 stack and store efficiently in cabinets or drawers when not being used.

The ice plugs 14 created in the Ice Cube Tray Device 10 of the present invention keep a bottled beverage chilled for individuals to carry along and imbibe over a period of time. The ice plugs 14 produced by the Ice Cube Tray Device 10 fit neatly into a drinker's bottle of choice. Durably constructed, the Ice Cube Tray Device 10 will withstand many years of continued use.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

The invention claimed is:

1. An ice cube tray device for creating ice plugs for a beverage container, the beverage container having an opening, the ice cube tray device comprising:

an ice tray having a top surface, a bottom surface opposite the top surface, a first end, and a second end opposite the first end; and a plurality of recessed receptacles formed in the top surface of the ice tray between the first end and the second end;

wherein each of the recessed receptacles have a substantially rounded cylindrical configuration thereby creating ice plugs having the same configuration as the recessed receptacles that are capable of being received within the opening of the beverage container and further comprising:

a first handle formed on the first end of the ice tray; and a second handle formed on the second end of the ice tray, wherein the plurality of recessed receptacles have a variety of sizes, and further wherein the plurality of recessed receptacles are graduated in size with a pair of largest recessed receptacles positioned nearingly adjacent the first end of the ice tray and another pair of largest recessed receptacles positioned nearingly adjacent the second end of the ice tray, each of the largest recessed receptacles positioned nearingly adjacent one of four corners of the ice tray.

2. The ice cube tray device of claim 1 wherein the recessed receptacles extend in a general direction away from the bottom surface of the ice tray.

3. The ice cube tray device of claim 1 wherein the smallest recessed receptacles are positioned in the approximate center of the ice tray between the first end and the second end of the ice tray.

4. The ice cube tray device of claim 1 wherein the recessed receptacles between the smallest and largest recessed receptacles are sized greater than the smallest recessed receptacles and lesser than the largest recessed receptacles.

5. The ice cube tray device of claim 1 wherein different sized pair sets of medium and smaller recessed receptacles reside in the remaining top surface of the ice cube tray between the largest, outside corner compartments.

6. The ice cube tray device of claim 1 wherein multiple ice trays are stackable upon each other.

7. An ice cube tray device for creating ice plugs for a beverage container, the beverage container having an opening, the ice cube tray device comprising:

an ice tray having a top surface, a bottom surface opposite the top surface, a first end, and a second end opposite the first end; and a plurality of recessed receptacles formed in the top surface of the ice tray between the first end and the second end, the plurality of recessed receptacles having a variety of sizes, the plurality of recessed receptacles are graduated in size from smallest recessed receptacles to largest recessed receptacles;

wherein the largest recessed receptacles are positioned nearingly adjacent the first end and the second end of the ice tray nearingly adjacent each of approximately four corners of the ice tray;

wherein the smallest recessed receptacles are positioned in the approximate center of the ice tray;

wherein the largest recessed receptacles extend from the bottom surface of the ice tray in a generally downward direction; and wherein each of the recessed receptacles have a substantially rounded cylindrical configuration thereby creating ice plugs having the same configuration as the recessed receptacles that are capable of being received within the opening of the beverage container.

8. The ice cube tray device of claim 7 and further comprising:

a first handle formed on the first end of the ice tray; and a second handle formed on the second end of the ice tray.

9. The ice cube tray device of claim 7 wherein the recessed receptacles between the smallest and largest recessed receptacles are sized greater than the smallest recessed receptacles and lesser than the largest recessed receptacles.

10. The ice cube tray device of claim 7 wherein the plurality of recessed receptacles is twelve.

11. The ice cube tray device of claim 7 wherein multiple ice trays are stackable upon each other.

12. The ice cube tray device of claim 7 wherein the ice tray is constructed from a food-grade, injection molded thermoplastic.

13. The ice cube tray of claim 7 wherein the recessed receptacles support the ice tray on a surface.

* * * * *